US006268797B1

(12) United States Patent
Berube et al.

(10) Patent No.: US 6,268,797 B1
(45) Date of Patent: Jul. 31, 2001

(54) INTEGRATED PORTABLE TRACKING SIGNAL AND ACCESS AUTHORIZATION SIGNAL GENERATOR

(75) Inventors: James E. Berube, Farmington; Michael D. Robinson, Weedsport, both of NY (US)

(73) Assignee: Detection Systems, Inc., Fairport, NY (US)

( * ) Notice: Subject to any disclaimer, the term of this patent is extended or adjusted under 35 U.S.C. 154(b) by 0 days.

(21) Appl. No.: 09/525,985

(22) Filed: Mar. 15, 2000

(51) Int. Cl.[7] ..... G08B 13/00

(52) U.S. Cl. ..... 340/573.1; 340/825.34; 340/825.36; 340/825.69; 340/825.72; 340/825.73

(58) Field of Search ..... 340/573.1, 540, 340/568.1, 568.6, 568.7, 571, 572.1, 573.3, 573.4, 573.5, 825.3, 825.31, 825.34, 825.36, 825.49, 825.69, 825.71, 825.74, 825.72, 825.73; 342/42

(56) References Cited

U.S. PATENT DOCUMENTS 3,706,930 * 12/1972 Harner ..... 325/158
4,218,681 * 8/1980 Hormann ..... 455/603
4,598,275 * 7/1986 Ross et al. ..... 340/825.31
4,918,432 * 4/1990 Pauley et al. ..... 340/825.72
5,053,774 10/1991 Berube .
5,097,416 * 3/1992 Matthews ..... 340/323 R
5,115,224 * 5/1992 Kostusiak et al. ..... 340/825.49
5,191,348 * 3/1993 Brocia et al. ..... 342/173
5,218,344 * 6/1993 Ricketts ..... 340/825.31
5,303,972 * 4/1994 Heider et al. ..... 296/98
5,578,989 11/1996 Pedtke .
5,604,493 2/1997 Behlke .
5,629,981 5/1997 Nerlikar .
5,705,980 * 1/1998 Shapiro ..... 340/825.49
5,714,932 * 2/1998 Castellon et al. ..... 340/825.06
5,734,968 * 3/1998 Lay ..... 340/825.75
5,926,103 * 7/1999 Petite ..... 340/825.49
5,959,533 * 9/1999 Layson, Jr. et al. ..... 340/825.54

* cited by examiner

*Primary Examiner*—Jeffery Hofsass
*Assistant Examiner*—Daniel Previl
(74) *Attorney, Agent, or Firm*—Brian B. Shaw, Esq.; Stephen B. Salai, Esq.; Harter, Secrest & Emery LLP

(57) ABSTRACT

A hand held unit is disclosed, the unit including a tracking signal generator and an access authorization signal generator, each signal generator being separately and independently actuatable by a user.

10 Claims, 3 Drawing Sheets

INTEGRATED PORTABLE TRACKING SIGNAL AND ACCESS AUTHORIZATION SIGNAL GENERATOR

FIELD OF THE INVENTION

The present invention relates to personnel and asset tracking systems as well as access authorization, and more particularly relates to an integrated system providing a portable RF tracking transmitter and access authorization signal generator.

BACKGROUND OF THE INVENTION

A number of personal security systems include portable radio frequency (RF) transmitters carried by a system subscriber for actuation in an emergency or threatening situation. Typically, fixed receivers monitor an area where the system is installed and initiate a planned sequence of events when the emergency transmission is detected. Sirens and/or strobes may be energized to ward off attackers while a call is made to appropriate security personnel for assistance. The system usually is monitored from a control station including software or a program for identifying the approximate location of the threatened subscribers.

Theses systems typically employ a portable or hand-held transmitter which is carried by a subscriber. For individuals to take advantage of this technology, the individual must carry the security (tracking) transmitters. Carrying the transmitter itself is not a significant burden. However, when combined with various keys, cards and other similar devices people carry, the collection of the elements becomes quite cumbersome. This burden is an incentive for an individual to avoid carrying some items. If the individual fails to carry the transmitters the benefits of the system are lost.

Therefore, there is a need for integrating otherwise disparate technologies while maintaining the accessibility and hence viability of each technology. The further need exists for a system which can perform a desired tracking or security functions as well as incorporate alternate technologies.

SUMMARY OF THE INVENTION

The present invention provides an integrated personnel or asset tracking system for industrial, commercial or institutional applications with access authorization capabilities in a single portable unit.

The present tracking transmitter may be employed in either a security system or an asset tracking system, and the access authorization may be applied to physical areas (restricted areas) as well as controls including control systems and financial applications such as debit cards and associated databases.

The present portable unit is hand held in that it is readily carried on a person. In a first configuration, the hand held unit includes a tracking radio frequency (RF) transmitter and an RF access signal generator selected to obtain access with respect to a predetermined receiver.

In a second configuration, the hand held unit incorporates a tracking RF transmitter and a proximity sensor for generating lower frequency signal in response to a movement of the hand held unit through a magnetic field, so as to generate a unique access authorization signal. In a further configuration, the proximity device does not require movement relative the magnetic field, but rather is presented to an electromagnetic field, such is a 125 KHz field.

DETAILED DESCRIPTION OF THE PREFERRED EMBODIMENT

Figure 1:
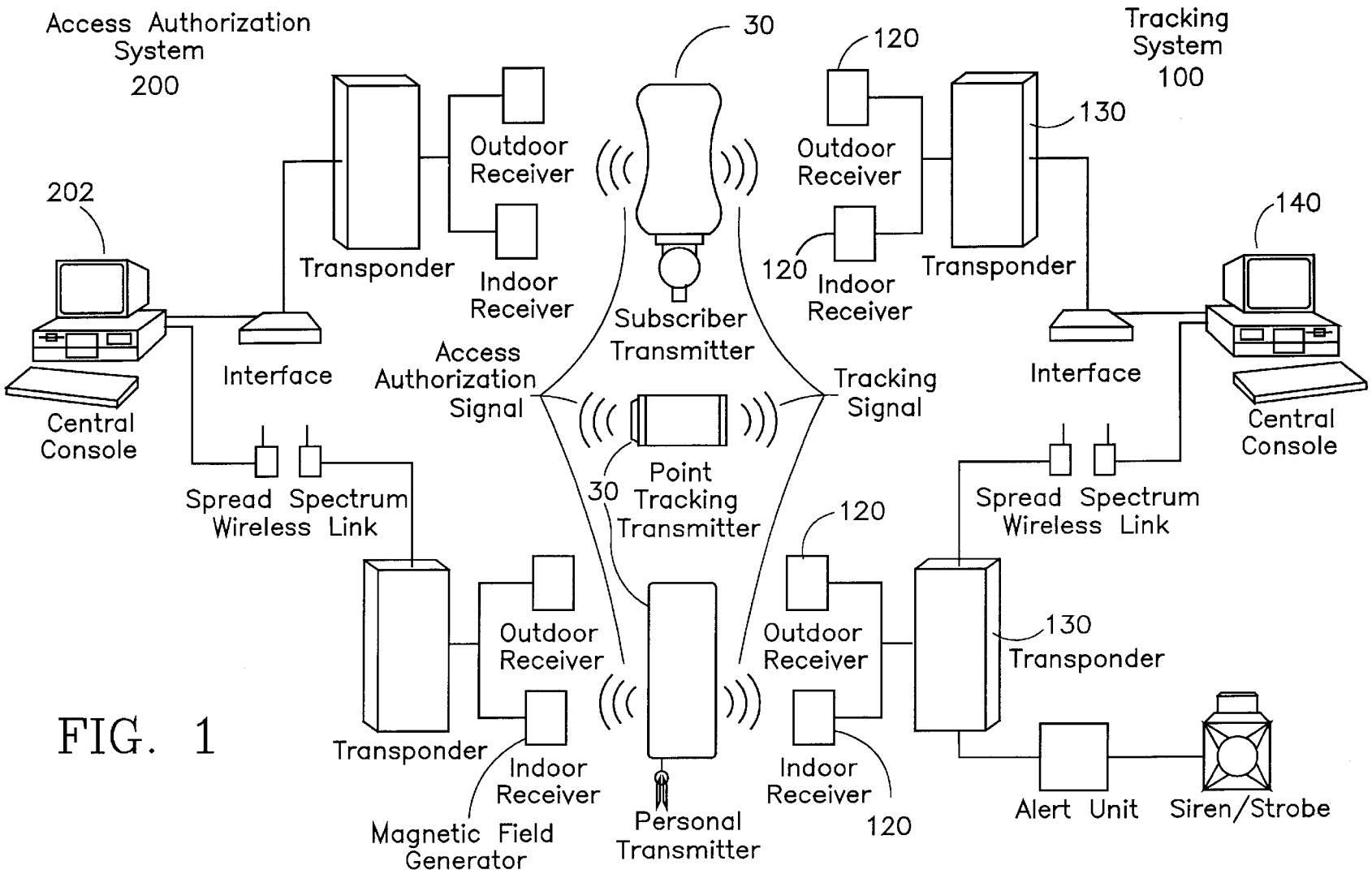
FIG. 1 is a system configuration diagram showing the tracking component.
Figure 2:
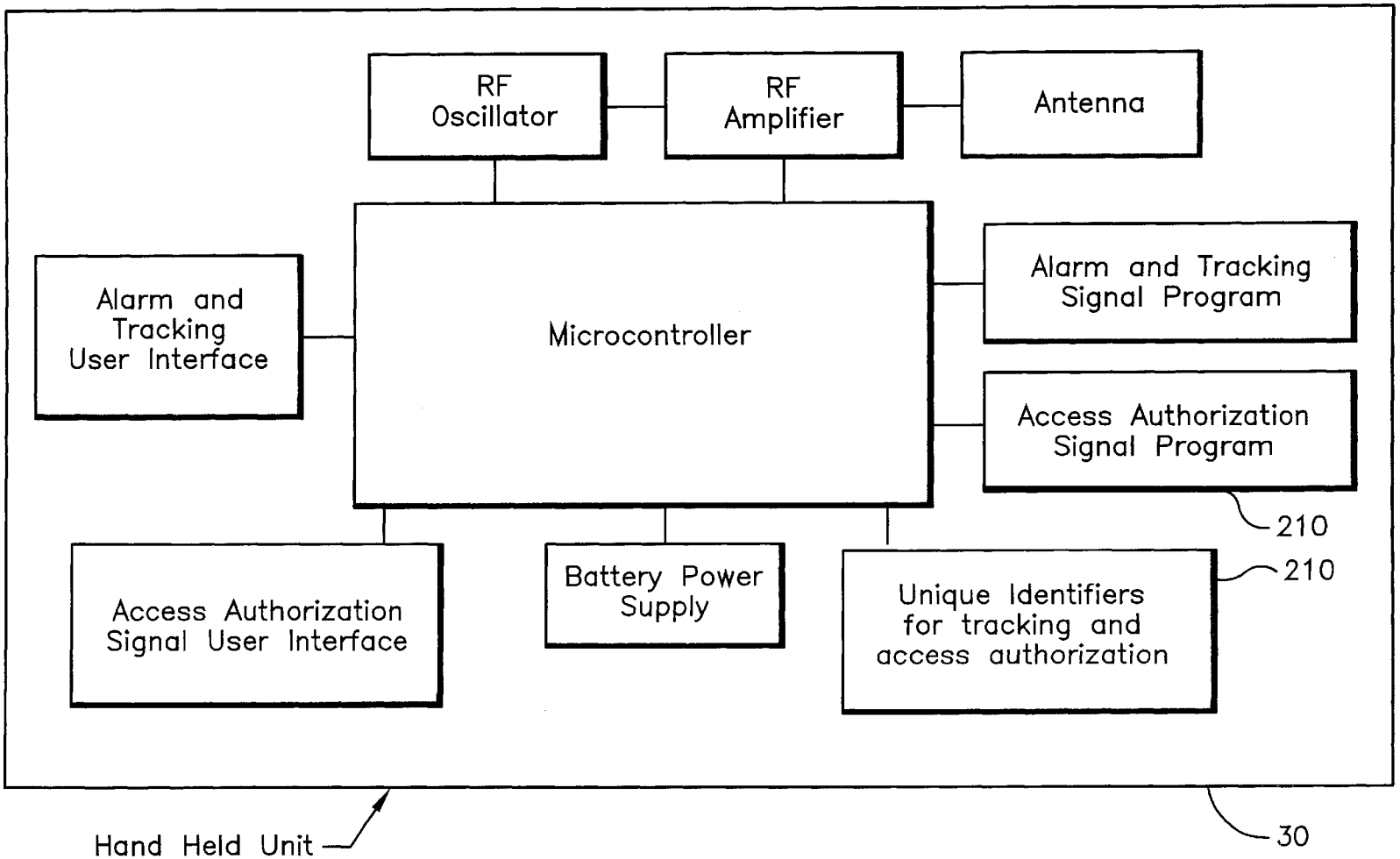
FIG. 2 is a schematic (block) diagram showing a first configuration of the present invention.
Figure 3:
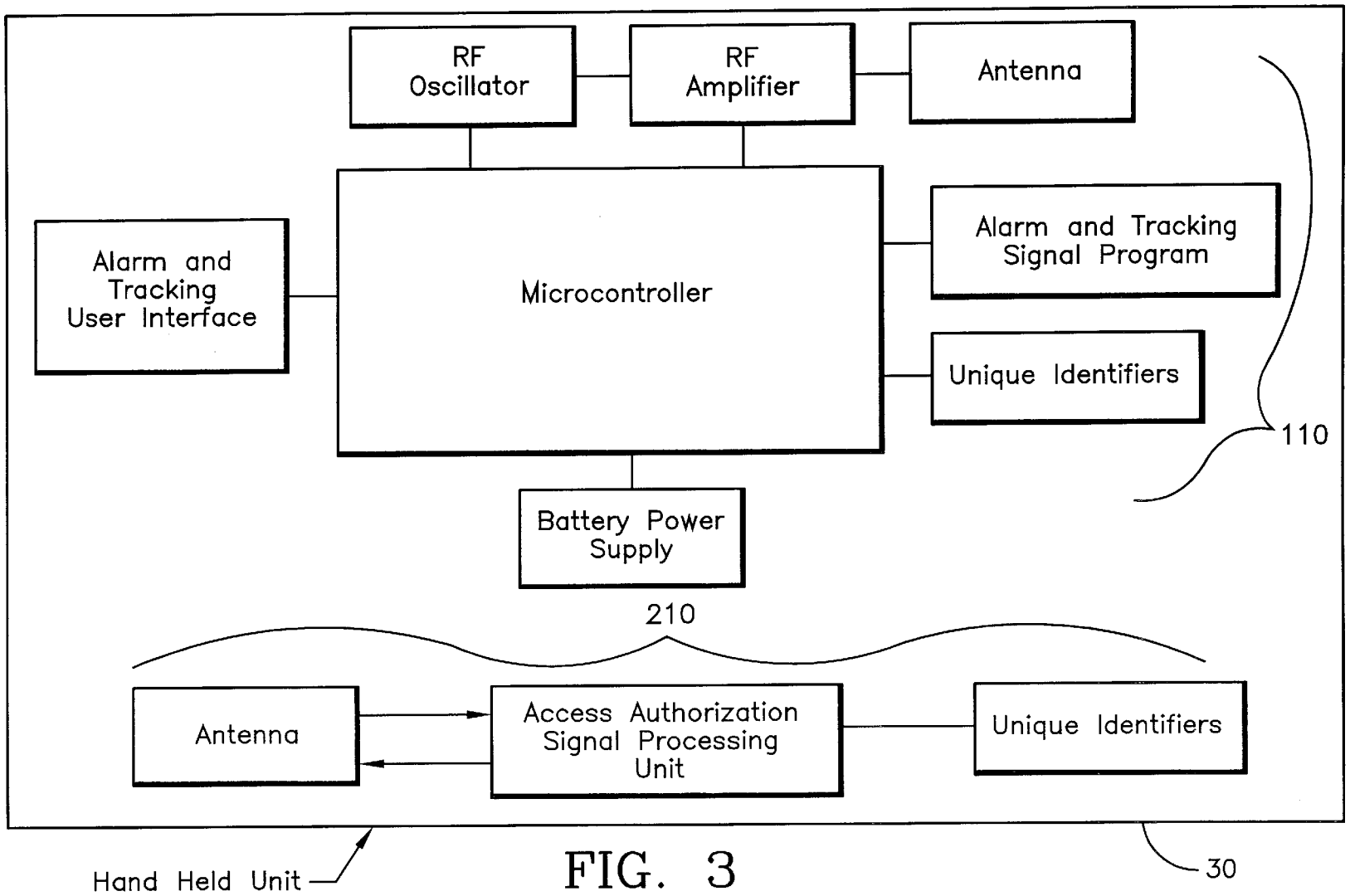
FIG. 3 is a schematic (block) representation of an alternative configuration of the present invention.

The present invention cooperates with a tracking system 100 and an access authorization system 200, wherein components of each system are integrated into a single portable hand held unit 30.

The term "tracking" is intended to encompass personnel or asset tracking for industrial, commercial or institutional applications. The term "access" is intended to encompass, but not be limited to access to physical locations, databases or operating and control systems. It is understood the access may include debit or payment systems as well as credit systems.

The hand held unit 30 can be any of variety of configurations for transport by an individual. For example, the unit 30 may be configured to clip onto a belt, or pocket. Alternatively, the unit 30 may be sized to be received in a shirt, coat or pants pocket. Further configurations include the unit 30 selected to engage a strap, cord lanyard or other tether which is carried by or attached to the individual. The hand held unit 30 may encompass those attached to the belt or a key fob, a badge or a neck or wrist strap. That is, the hand held unit 30 is readily portable and associated with a particular person (or asset) and while it may be of a hand-held configuration it encompasses those unit disposed on other portions of the body or clothing. Each of the these and any equivalent constructions arc encompassed by the term "hand held unit 30."

Tracking System

The tracking system 100 generally includes transmitters 110, receivers 120, transponders 130, and a central console 140. In a particular configuration it is also understood the tracking system may include alert units. By way of example, U.S. Pat. No. 5,572,192 issuing Mar. 7, 1994 and U. S. Pat. No. 5,717,378 issuing Apr. 1, 1996, are hereby expressly incorporated by reference.

Referring now to FIG. 1, a configuration of the invention is depicted in a personal security system including the wireless, hand-portable unit 30 having transmitters 110, one or more local receiving networks 120/130, and the central control 140.

The transmitters 110 are carried in the hand held unit 30 by subscribers to the system for actuation in emergency or threatening situations to scare away attackers and call for assistance. The transmitters 110 send a radio frequency signal to the surrounding area, at a predetermined frequency and signal strength, including a unique code that identifies the transmitter. Alternatively, the signal strength of the transmitter 110 does not need to be predetermined. Thus, the system can employ the relative signal strengths received by the different receivers reporting the signal.

The local networks include a plurality of receivers 120, alarms and a local control (transponder) 130 coupled through a communications link to the central control 140. The local networks monitor the protected area for emergency transmissions and, in combination with the central control, activate the alarms. The local networks also detect information about the transmitted signal, including the strength of the received signal and the transmitter identification. This information is stored and forwarded to the central control for determining the location of the emergency transmission and the name of the subscriber to which the transmitter is assigned.

The central control 140 validates the transmission, by comparing the transmitter identification to a database of subscribers. Assuming the transmission is from a current subscriber, alarms are activated in the vicinity of the transmission, and security personnel are dispatched to the same area for assistance.

Although these components are fully set forth in the incorporated references, a brief description is set forth to assist the understanding of the present invention.

Transmitter

The transmitter 110 is located in the hand held unit 30 and includes a miniature radio frequency (RF) tracking transmitter containing a unique code to the particular tracking transmitter. Upon activation, the tracking, transmitter 110 venerates an alarm or tracking signal.

The tracking transmitter 110 contains a unique code which is associated with the user at the time the tracking transmitter 110 is assigned. The tracking transmitter may operate in a variety of modes to provide a variety of alarm signals such as a manual distress alarm initiated by pressing a large button on the transmitter; a man-down alarm which will transmit an alarm upon a predetermined orientation of the transmitter; and a lanyard pull alarm in response to removal of a pin from the tracking transmitter.

In addition, subsequent to an alarm signal, the tracking transmitter 110 may automatically resend the signal every few seconds to update the location of the transmitter.

Alternatively, the transmitter 110 may be employed with supervision tracking wherein the transmitter will send a tracking signal to the central console to allow monitoring of the transmitter's location.

As the tracking transmitter 110 in located in the hand held unit 30, the unit includes actuating buttons or grips for selectively actuating the tracking transmitter. Preferably, these buttons are located and biased to reduced unintended actuation, without inhibiting use in times of user duress.

Receivers

The receivers 120 are located throughout the range to be monitored such as the grounds or buildings. The receiver 120 may also include sounders which may be activated upon reception of a particular signal. The receiver 120 is preferably housed to permit either indoor or outdoor operation.

Each receiver 120 contains a radio receiver to detect transmissions from the transmitters and a microprocessor to decode and interpret the received signal such as test and alarm signals. The receivers 120 are configured such that upon detecting an alarm from a transmitter, a corresponding signal is sent to the transponder 130.

Transponder

The transponder 130 continuously monitors the operation of a group of receivers 120 to maintain system integrity as well as querying receivers. The transponder 130 collects and summarizes signals and relays the data to the central console 140. The transponder 130 may also communicate with the receivers 120 in response to signals from the control console 140.

The primary function of the transponder 130 is to monitor the receivers 120 and any alert units, if employed, and report conditions and events to the central console via either a wire or radio signal. In addition, the transponder 130 may provide power output to selected devices.

Central Console

The central console 140 includes a computer and associated software for monitoring and processing signals. The central console 140 receives a signal from the transponder 130 and determines the location of the transmitter 110 and hence unit 30 as well as the individual or asset to whom the transmitter has been issued. In addition, the central console 140 may present the location and identify information on a visual display such as a computer screen.

In a preferred configuration, the central console 140 also contains subscriber and operating data bases used to check subscriber identify and operator passwords and authority levels.

The central console 140 also monitors all transponders and reports component or system faults.

Thus, the tracking component of the present invention may be used for security systems and thereby providing location of an activated transmitter. Alternatively, the tracking component may be implied on assets which may move through various stages of a facility.

Access Authorization System

The access authorization system 200 includes an access authorization signal generator 210 for cooperatively interfacing with a restricted resource 202. The restricted resource 202 may be any of a variety of elements, including but not limited to a restricted area in a building, facility or plant. Similarly, the restricted resource 202 may be an operating system or control system. Further restricted resources 202 include databases, ATMs, automated vending machines, gas pumps, as well as services such as pay per use institutions including tolled highways.

The access authorization signal generator 210 is also located in the hand held unit 30. Thus, the hand held unit 30 houses the RF tracking transmitter 110 and the access authorization signal generator 210.

The access authorization signal generator 210 is retained in the hand held unit 30 and may be any of the variety of configurations, such as an RF access authorization signal generator or a proximity sensor.

In the RF access authorization signal generator, a tracking transmitter is controlled in the unit 30 to produce a separate distinct access authorization signal. Generally, the access authorization signal is substantially weaker than the tracking signal. Typically the access signal is the same strength as the tracking signal, and the receivers are significantly detuned so they require the transmitter to be relatively close, typically on the order of 0.5 to 18 inches away.

The access authorization signal is directed to a separate access receiver or reader, which is configurated to respond to the transmitted access authorization signal and grant or deny access to the associated restricted resource. Preferably, the access authorization signal is selectively activated to transmit the access authorization signal.

In an alternative configuration, the access authorization signal is generated by a proximity sensor. In the configuration, the hand held unit includes a loop or coil of wire connected to a circuit, such as on a chip, for generating a lower frequency access authorization signal. U.S. Pat. Nos. 5,053,774 and 5,629,981 are hereby expressly incorporated by references.

In use, the user presents the and hand held unit 30 and hence the coil to a magnetic field to generate and electric current in the coil. The generated current is passed through the circuitry which then produces and transmits a predetermined access authorization signal.

A benefit of the present invention is the incorporation and integration of the tracking signal generator and the access authorization signal generator in a single hand held housing 30.

It is also contemplated the access authorization signal may be encrypted. That is, the transferred signal is in the form of a cyphertext. The specific encryption is at least partially determined by the intended operating environment and associated risks.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims which scope is to be accorded the broadest interpretation so as to encompass all such modifications and equivalent structures.

What is claimed is:

1. A personal tracking device, comprising:

(a) a hand held housing;

(b) a tracking signal generator located in the hand held housing, the tracking signal generator selectively actuatable to produce a tracking signal; and (c) an access authorization signal generator located in the hand held housing selectively actuatable to generate an access authorization signal independent of the tracking signal.

2. The personal tracking device of claim 1, wherein the access authorization signal is encrypted.

3. The personal tracking device of claim 1, wherein the tracking signal and the access authorization signal are the same strength.

4. The personal tracking device of claim 1, wherein the access authorization signal is weaker than the tracking signal.

5. The personal tracking device of claim 1 , wherein the tracking signal is weaker than the access authorization signal.

6. The personal tracking device of claim 1, wherein the access authorization signal generator is an RF transmitter.

7. The personal tracking device of claim 1, further comprising a wire coil carried by the housing, and operably connected to the access authorization signal generator.

8. A hand-held transmitter, comprising:

a tracking signal generator selectively actuatable to produce a tracking signal to a receiver system;

a proximity sensor disposed in the housing for generating a lower frequency signal to generate an access authorization signal; and a portable housing sized to be carried by an individual and retaining the tracking signal generator and the proximity sensor.

9. The apparatus of claim 8, wherein the proximity sensor includes a coil in the handheld housing, the coil is selected to produce an electric current upon being presented to a sufficient magnetic field to generate the authorization access signal.

10. The apparatus of claim 9, wherein the proximity sensor includes a circuit electrically connected to the coil.

* * * * *